US008888432B1

(12) United States Patent
Guidroz et al.

(10) Patent No.: US 8,888,432 B1
(45) Date of Patent: Nov. 18, 2014

(54) TUBULAR DELIVERY APPARATUS AND SYSTEM

(76) Inventors: Perry Guidroz, Breaux Bridge, LA (US); Donald R. Harrington, Lafayette, LA (US); Alfred J. Thomas, III, Lafayette, LA (US)

( * ) Notice: Subject to any disclaimer, the term of this patent is extended or adjusted under 35 U.S.C. 154(b) by 125 days.

(21) Appl. No.: 13/157,445

(22) Filed: Jun. 10, 2011

Related U.S. Application Data

(60) Provisional application No. 61/353,504, filed on Jun. 10, 2010.

(51) Int. Cl.
*E21B 10/00* (2006.01)
*E21B 19/14* (2006.01)
*E21B 19/15* (2006.01)

(52) U.S. Cl.
CPC ..... *E21B 19/15* (2013.01); *E21B 19/155* (2013.01)
USPC ..... 414/22.54; 414/22.59; 414/22.62; 211/70.4

(58) Field of Classification Search
USPC ..... 414/22.54, 22.59–22.62, 589, 745.4, 414/746.4, 746.8, 22.51–22.71; 211/70.4; 187/211, 215, 243, 244; 254/93 L, 93 R, 254/93 H
See application file for complete search history.

(56) References Cited

U.S. PATENT DOCUMENTS 2,535,546 A 12/1950 Pitts
2,576,907 A 11/1951 Wallace
2,576,908 A 11/1951 Wallace
2,617,547 A 11/1952 Pridy
2,643,006 A 6/1953 King
2,656,052 A 10/1953 Tucker
2,790,683 A 4/1957 Clark
2,880,881 A * 4/1959 Robishaw ..... 211/70.4
2,922,533 A 1/1960 LaBarge, Jr.
3,053,401 A 9/1962 Jinkins, Jr.
3,254,776 A * 6/1966 Brown ..... 414/22.61
3,259,255 A 7/1966 Cresci
RE26,284 E * 10/1967 O'Neill et al. ..... 175/57
3,499,498 A * 3/1970 Bromell et al. ..... 175/52
3,559,821 A 2/1971 James
3,630,392 A * 12/1971 Cintract et al. ..... 414/746.8
3,706,347 A 12/1972 Brown
3,792,783 A 2/1974 Brown
3,810,553 A * 5/1974 Crocker et al. ..... 414/22.61
3,986,619 A 10/1976 Woolslayer et al.
4,051,956 A * 10/1977 Teague ..... 414/746.4
4,054,210 A 10/1977 Crocker
4,067,453 A * 1/1978 Moller ..... 414/22.61
4,140,227 A 2/1979 Beck
4,158,524 A 6/1979 Serafin
4,235,566 A 11/1980 Beeman et al.
4,253,792 A 3/1981 Nishikawa (Continued)

*Primary Examiner* — Gregory Adams
*Assistant Examiner* — Lynn Schwenning

(57) ABSTRACT

A tubular delivery stand utilized for lifting a length of pipe to a desired level is disclosed. The tubular delivery stand may also serve as a support stand for a pipe pickup and laydown apparatus in order to increase the height of the lift capable by the referenced pickup and laydown apparatus. The tubular delivery stand is constructed of two similarly configured stand sub-frames that are pinned together at their base to form a complete stand frame. Elevator columns that support an elevator assembly is provided for raising and lowering pipe along the side of the deliver stand. A pipe removal assembly is provided for laying down pipe onto a pipe rack.

15 Claims, 6 Drawing Sheets

(56) References Cited

U.S. PATENT DOCUMENTS

| | | | | | |
|---|---|---|---|---|---|
| 4,347,028 | A | | 8/1982 | Dugan | |
| 4,371,302 | A | | 2/1983 | Frias et al. | |
| 4,380,297 | A | * | 4/1983 | Frias | 211/70.4 |
| 4,439,091 | A | * | 3/1984 | Frias | 414/22.59 |
| 4,474,520 | A | * | 10/1984 | Buckner et al. | 414/22.61 |
| 4,486,137 | A | * | 12/1984 | Buckner | 414/22.61 |
| 4,494,899 | A | * | 1/1985 | Hoang et al. | 414/22.61 |
| 5,273,388 | A | * | 12/1993 | Willis et al. | 414/22.54 |
| 6,860,694 | B2 | * | 3/2005 | Slettedal | 414/22.51 |
| 7,631,581 | B2 | * | 12/2009 | Bangert | 81/57.35 |
| 7,635,249 | B2 | | 12/2009 | Guidroz | |
| 7,665,944 | B2 | | 2/2010 | Guidroz | |
| 7,854,265 | B2 | * | 12/2010 | Zimmermann | 166/379 |
| 2003/0155154 | A1 | * | 8/2003 | Oser | 175/52 |
| 2006/0045655 | A1 | * | 3/2006 | Wells | 414/22.61 |
| 2008/0138174 | A1 | * | 6/2008 | Hawkins | 414/22.54 |
| 2010/0260555 | A1 | * | 10/2010 | Foo et al. | 405/201 |

* cited by examiner

TUBULAR DELIVERY APPARATUS AND SYSTEM

PRIORITY CLAIM

This application claims priority to U.S. Provisional Application Ser. No. 61/353,504 filed Jun. 10, 2010 by Applicant.

FIELD OF INVENTION

The present invention relates to a device for lifting a tubular joint of pipe. More specifically, this invention relates to a modular freestanding pipe lifting apparatus.

BACKGROUND OF INVENTION

Oil and gas drilling and production operations often require the use of long strings of pipe or tubing. Such pipe strings are sometimes called tubing strings and the strings of tubing are typically comprised of individual segments of pipe or tubing that are secured together to form the strings. These individual segments or pipe are called pipe joints or tubing joints.

During such drilling and production operations, individual pipe joints may be added or removed from a pipe string. These individual pipe joints are typically at least thirty feet in length and are extremely heavy. Consequently, a pipe lifting apparatus is typically utilized for lifting the heavy joints of pipe.

SUMMARY OF INVENTION

The present invention provides a portable, modular, pipe lifting apparatus for lifting a length of pipe. The pipe lifting apparatus, referred to herein as a tubular delivery stand, is intended to be utilized in conjunction with the pipe pickup and laydown apparatus described in U.S. Pat. Nos. 7,635,249 and 7,665,944, the disclosures of which are adopted herein by reference. These patents disclose and provide a lifting apparatus and method for a self-contained, freestanding modular unit that is fully portable and easily operated.

The tubular delivery stand described herein may be utilized for lifting a length of pipe to a desired level. The described tubular delivery stand may also serve as a support stand for the above referenced pipe pickup and laydown apparatus in order to increase the height of the lift capable by the referenced pickup and laydown apparatus.

The tubular delivery stand is comprised of a support frame that is constructed of two similarly configured stand sub-frames. The two stand sub-frames are pinned together at their base to form a complete stand frame unit. The stand sub-frames are configured to provide for ease of shipping and assembly at a work site.

Each stand sub-frame of the tubular delivery stand has an elevator column that supports an elevator assembly. Each elevator assembly is comprised of a wheeled lift skate that moves vertically upward and downward by means of a vertically oriented reciprocating actuator and a hoist network comprised of a cable, sheave and pulley system. The actuator may be a hydraulic or pneumatic cylinder and piston actuator or a screw-type mechanical actuator. Each skate on the elevator assembly is provided with a pipe support that is comprised of an upwardly angled and extending pipe retaining beam to retain a length of pipe for the lift. Each skate may also be provided with a removable pipe laydown cradle to retain a length of pipe for laying down pipe onto a horizontally oriented pipe rack. An adjustable pipe roller guide assembly is provided to facilitate removal of pipe from the pipe laydown cradle onto a pipe rack.

In use in lifting a pipe or tubing joint, the stand sub-frames of the tubular delivery stand are assembled to form the tubular delivery stand as a single stand frame unit. The stand is placed adjacent to a pipe rack that supports a plurality of horizontally oriented pipe joints. The pipe supports on the skates of the elevator assemblies are positioned in the low or down position with respect to the pipe rack where a horizontally oriented pipe joint may be rolled off of the pipe rack and onto the pipe supports of the tubular delivery stand. The tubular delivery stand actuators of the stand elevator assemblies are then activated to raise the pipe joint to the top of the tubular delivery stand.

The tubular delivery stand may be used alone or in conjunction with the pipe pickup and laydown apparatus and method described in U.S. Pat. Nos. 7,635,249 and 7,665,944. When used in conjunction with the described pipe pickup and laydown apparatus, the pickup and laydown apparatus is placed atop the conjoined sub-frames of the tubular delivery stand so that the pipe pickup and laydown apparatus is fully supported by the tubular delivery stand. When so supported, the lifting jacks of the above described pickup and laydown apparatus may be utilized to pick up the pipe joint from the pipe supports of the tubular delivery stand so that a pipe joint may be placed in the trough of the referenced pipe pickup and laydown apparatus.

DESCRIPTION OF EMBODIMENT

Figure 1:
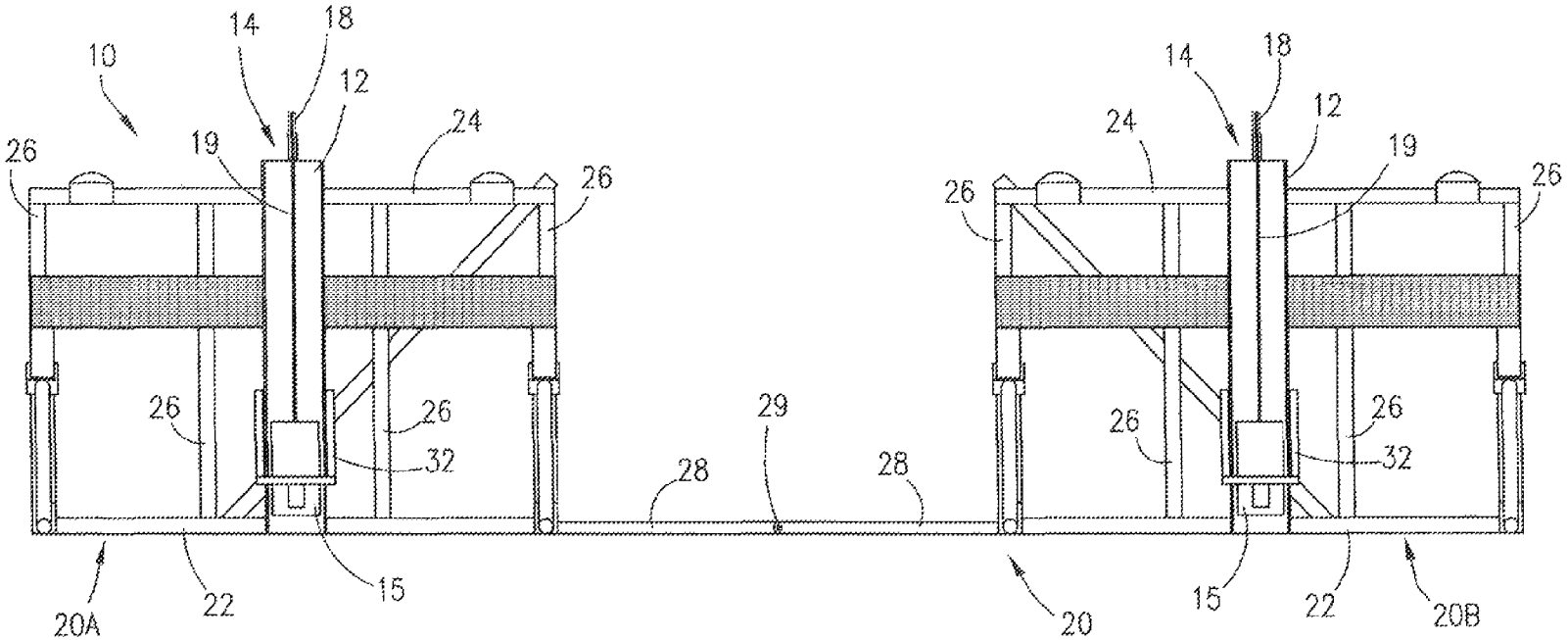
FIG. 1 is a front elevation view of the tubular delivery stand configured for pipe laydown.

Referring now to the drawings, more particularly to FIG. 1, there is shown a front elevation view of the tubular delivery stand (10). The tubular delivery stand (10) shown in FIG. 1 is shown configured for picking up and lifting pipe. The stand (10) is comprised of a support frame (20) that is constructed of two similarly configured sub-frames (20A) and (20B). Each of the sub-frames (20A) and (20B) has a horizontally positioned base frame (22) and a top frame (24) that is supported on vertically extending frame columns (26). Each of the sub-frames (20A) and (20B) is provided with a frame attachment and spacer bar (28).

The attachment and spacer bars (28) of the sub-frames (20A) and (20B) are provided with removable pins or bolts (29) so that sub-frames (20A) and (20B) may be pinned together at their base to form a longitudinally extending support frame (20). The support frame (20) is configured so that the sub-frames (20A) and (20B) may be shipped separately and assembled on a work site to form the support frame (20). Base spacer bars (28) are provided and configured in a manner that allows the two sub-frames (20A, 20B) to be pinned together so that a desired spacing between each of the sub-frames is maintained.

Figure 3:
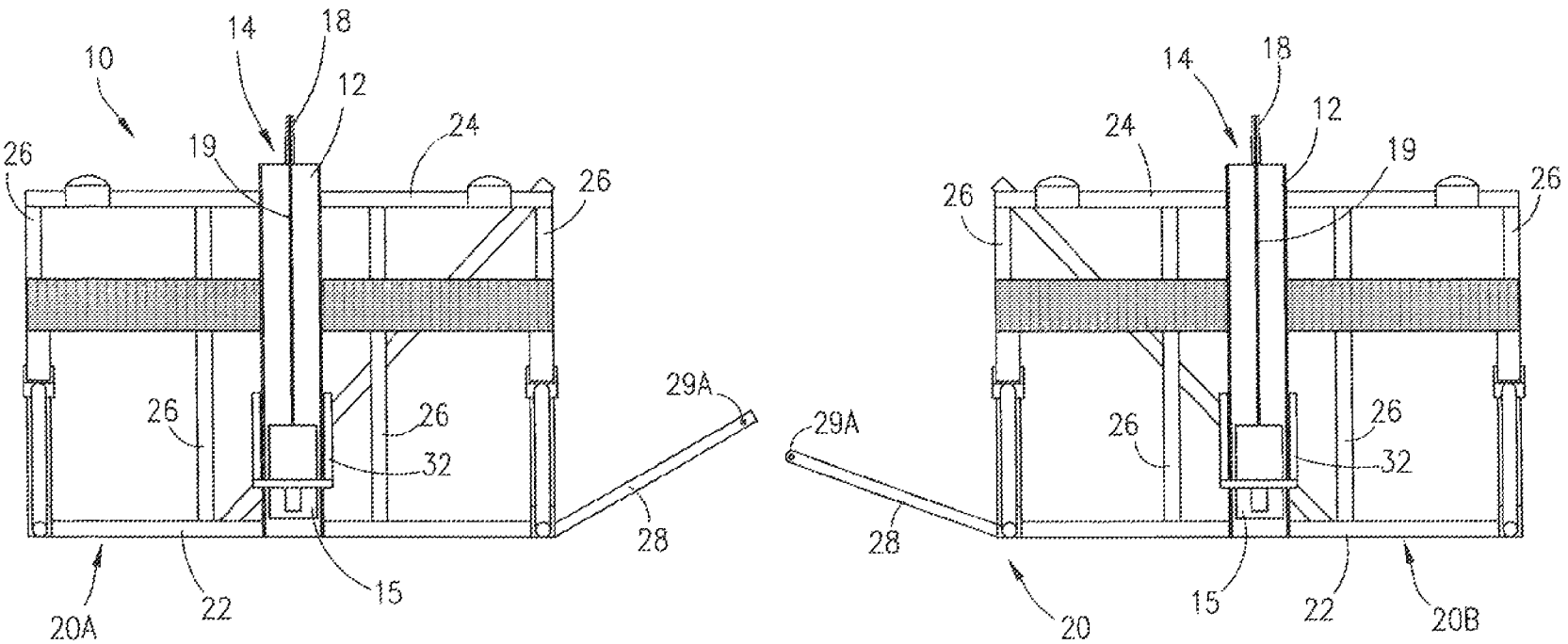
FIG. 3 is a front elevation view of the tubular delivery stand of FIG. 1 prior to assembly of the sub-frame components.

As shown in FIG. 3, for assembly of the stand (10), each sub-frame (20A) and (20B) is set in place with an opposing base spacer bars (28) pinned in position by pin (29) to complete the base (20). The pinned connection of opposing spacer bars (28) is accomplished by positioning the spacer bars (28) of each sub-frame (20A, 20B) at a slight upward angle so that the opposing base spacer bars (28) on each sub-frame can be pushed downward toward a horizontal position and connected by pins (29) in pin holes (29A) in a manner that will set apart at the desired spacing the sub-frames (20A, 20B).

Figure 2:
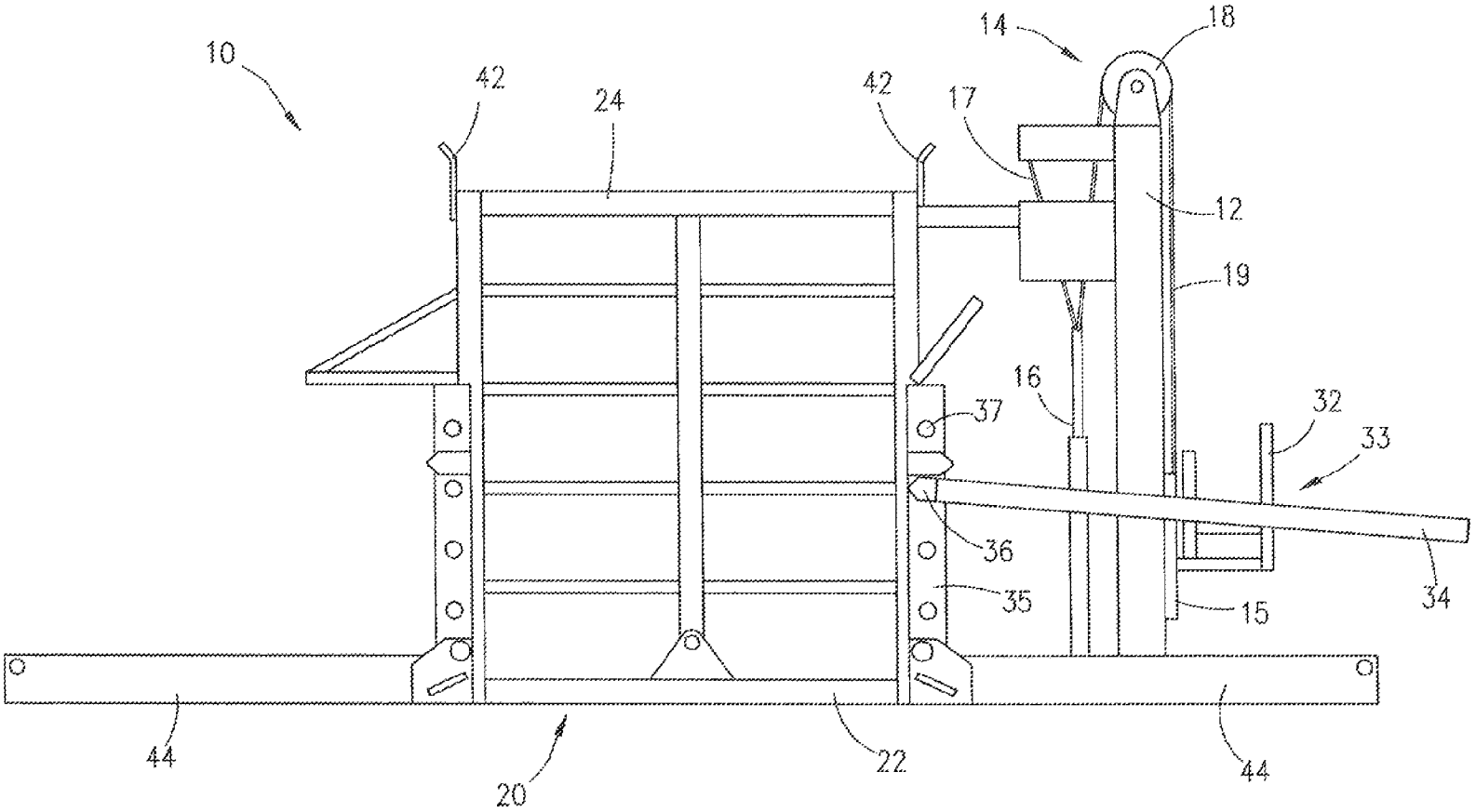
FIG. 2 is an end elevation view of the tubular delivery stand of FIG. 1 configured for laydown of a pipe joint.
Figure 4:
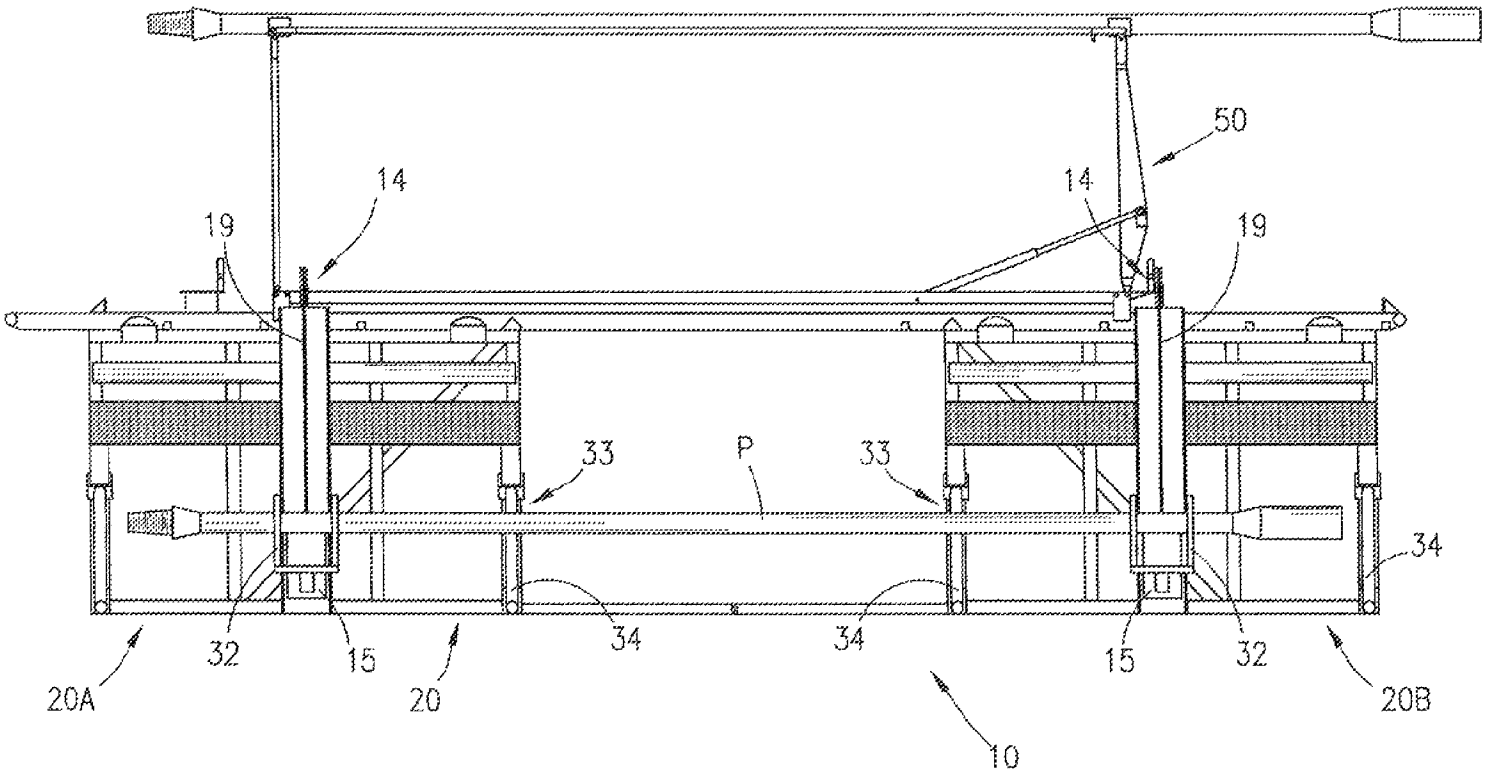
FIG. 4 is a front elevation view of the tubular delivery stand of FIG. 1 with a pickup and laydown machine installed upon the stand.
Figure 5:
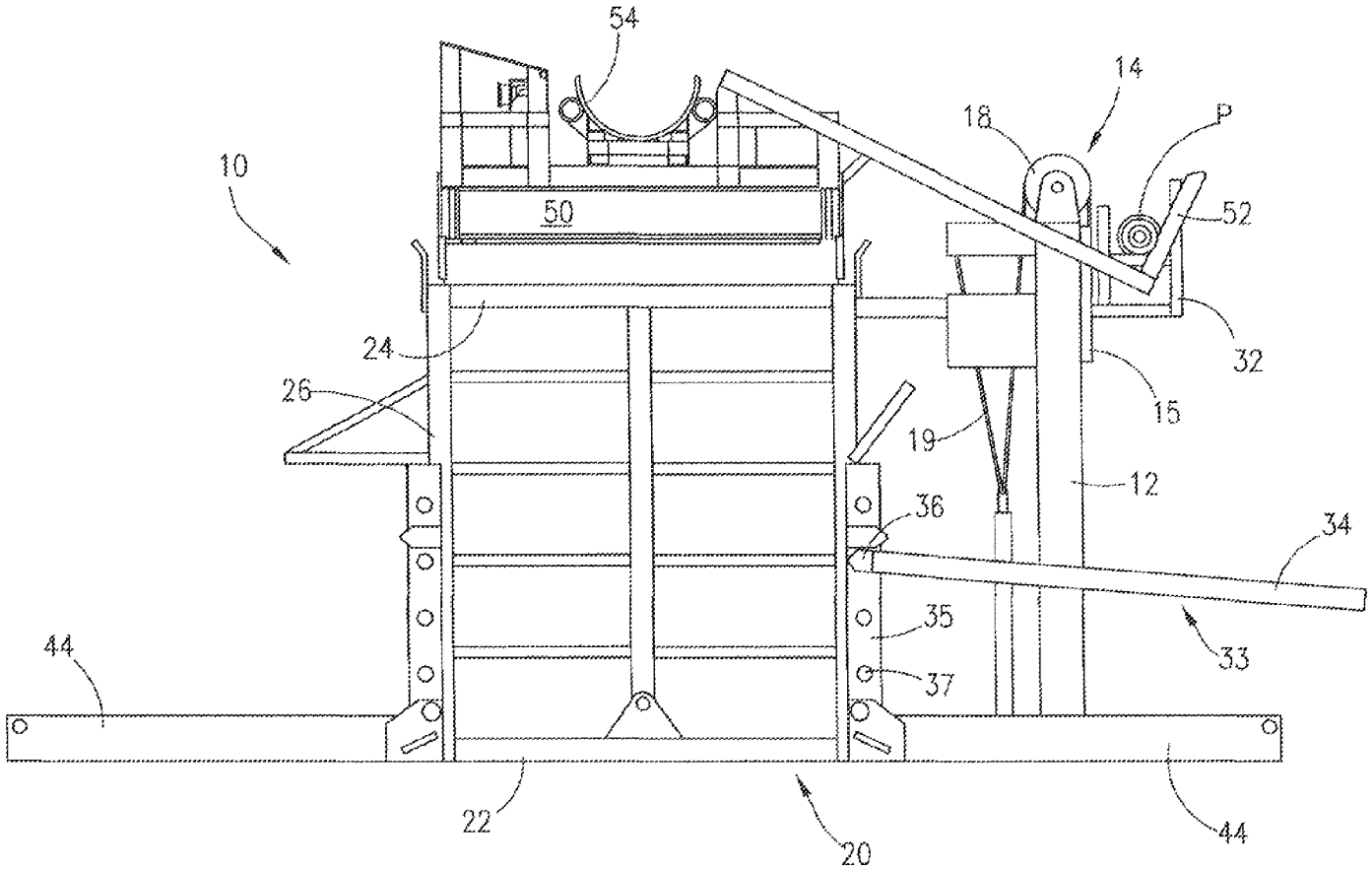
FIG. 5 is an end elevation view of the tubular delivery stand shown in FIG. 4.

As further shown in FIG. 1 and in FIGS. 2-4, an elevator column (12) is mounted on corresponding sides of each of the sub-frames (20A) and (20B) of the tubular delivery stand (10). Each elevator column (12) serves to support an elevator assembly (14). Each elevator assembly (14) is comprised of a wheeled lift skate (15), a vertically oriented reciprocating actuator (16) and hoist network comprised of a sheave and pulley system (18) and cable (19). The actuator (16) may be a hydraulic or pneumatic cylinder and piston actuator or a screw-type mechanical actuator. Reciprocal extension and retraction movement of each actuator (16) allows the wheeled lift skates (15) of each elevator assembly (14) to move vertically upward and downward from the base frames (22) to the top frames (24) along the elevator columns (12) on side of the stand (10) by means of pulling each cable (19) around the sheave and pulley system (18) of the hoist network (17).

A control mechanism (not shown) is provided so that each actuator (16) and its corresponding skate (15) will move simultaneously up and down the elevator columns (12). It is thought that the control mechanism will be a system of valves, switches or the like used to control reciprocating motion of the actuators (16).

As noted above while other types of actuators may be used, it is thought that the reciprocating actuators (16) for the elevator assemblies (14) will be hydraulic cylinder and piston actuators and that all operating motors, pumps, hoses and valves and controls, electrical, mechanical, or hydraulic, (not shown) for operation of the actuators (16) for simultaneous up will be provided with the stand (10).

As shown in FIGS. 1-5, when the stand (10) is configured for pipe laydown, each skate (15) is provided with a removable pipe laydown cradle (32) that will be used to retain a length of pipe (P) for laying down pipe onto a horizontally oriented pipe rack. Further, when the stand (10) is configured for pipe laydown, a pipe removal assembly (33) will also be provided.

The pipe removal assembly (33) is comprised of an adjustable pipe roller guide bar (34) having a pin hole at one end that is removably mounted by means of guide adjustment pin (36) to roller guide posts (35) mounted on each sub-frame (20A, 20B). The pipe roller guide bar (34) is provided to facilitate removable of pipe (P) from the pipe laydown cradle (32) onto the pipe rack. The roller guide posts (35) are provided with a plurality of having adjustment holes (37) in order to allow selective adjustment of the mounting position of the pipe roller guide bar (34) on the roller guide posts (35) by means of the adjustment holes (37) and the adjustment pin (36) and thereby adjustment of the angle and position of the roller guide with respect to each sub-frame (20A, 20B).

Figure 6:
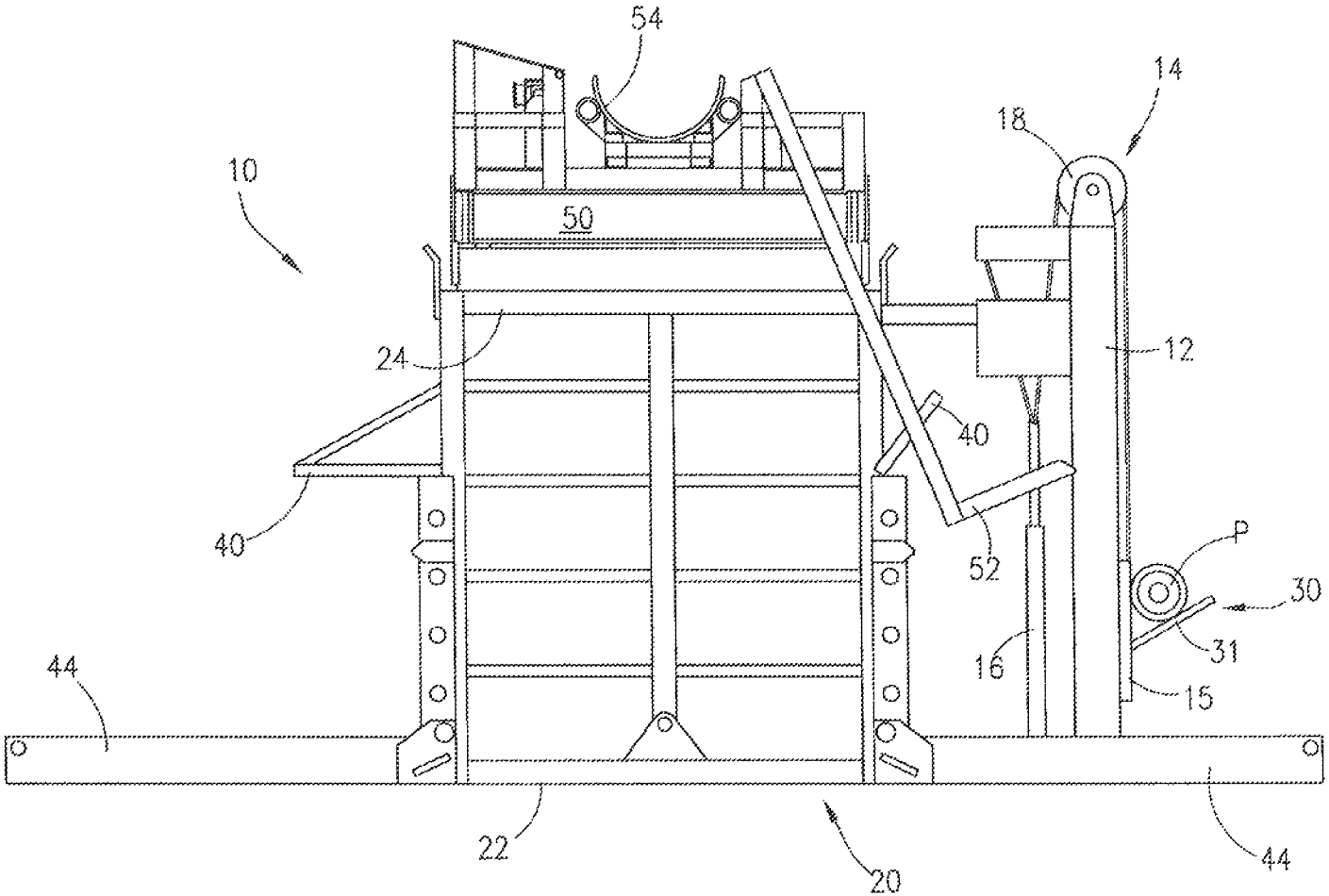
FIG. 6 is an end elevation view of the tubular delivery stand of FIG. 1 configured for pickup of a pipe joint.

As shown in FIG. 6, when the stand (10) is configured for pipe pickup, each skate (15) on the elevator assembly (14) is provided with a removable pipe support (30) that is comprised of an upwardly angled and extending pipe retaining beam (31) to retain the length of pipe (P) for pickup and lifting. For pickup of a pipe joint (P), the tubular delivery stand (10) is placed adjacent to a pipe rack (not shown) that is used for supporting pipe segments or joints (P) in a horizontal orientation. A pipe support (30) with extending pipe retaining beam (31) is attached to the skate (15) of each of the elevator assemblies (14) and the skates (15) are positioned in the low or down position with respect to the stand base (22). Then, a horizontally oriented length of pipe (P) may be rolled off of an adjacently positioned pipe rack and onto the pipe retaining beams (31) of pipe supports (30) of the tubular delivery stand (10). The actuators (16) of the elevator assemblies are then activated so as to raise the joint of pipe (P) to the top frame (24) of the tubular delivery stand (10).

When the tubular delivery stand (10) is used as a laydown stand, a laydown cradle (32) is removably mounted to each skate (15) of each elevator assembly (14) and a pipe roller guide (34) is attached at one end to a selected adjustment hole (37) on each roller guide posts (35) and the pipe roller guide (34) is angled as desired in the direction of a pipe rack (not shown). The skate (15) and mounted laydown cradle (32) is moved toward the top frame (24) of the stand (10) by manipulation of the actuators (16). Pipe (P) for laydown is then placed in the cradle (32) and the skate (15) and mounted laydown cradle (32) with the pipe (P) are then moved toward the bottom frame (22) of the stand (10) by manipulation of the actuators (16). As the laydown cradle (32) with the pipe (P) is moved downward, the pipe (P) is brought into contact with the pipe roller guides (34) and the pipe (P) is lifted from the cradle (32) and allowed to roll along the roller guides (34) onto an adjacent pipe rack. The process is repeated until all the pipe is laid down upon the pipe rack.

The tubular delivery stand (10) may be used alone or in conjunction with the pipe pickup and laydown apparatus and method described in U.S. Pat. Nos. 7,635,249 and 7,665,944. This is accomplished by placing the pipe pickup and laydown apparatus (50) atop the conjoined sub-frames (20A) and (20B) so that the pipe pickup and laydown apparatus (50) is fully supported on the tubular delivery stand (10). When so supported, the lifting jacks (52) of the above described pickup and laydown apparatus (50) may be utilized to pick up the pipe joint (P) from the pipe supports (30) of the tubular delivery stand (10) so that the pipe joint (P) may be placed in the trough (54) of the referenced pipe pickup and laydown apparatus. The referenced pipe pickup and laydown apparatus (50) may then be utilized as described in the aforementioned patents.

The tubular deliver stand (10) may be fitted with other components such as fold out walkways (40) to provide worker access along the top of the stand (10). The stand (10) may also be provided with alignment tabs (42) which serve to align the pickup and laydown apparatus (50) when it is supported on the stand (10). Lateral stabilizer bars (44) may also be provided to stabilize the stand (10) and sub-frames (20A) and (20B) during installation and operation.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A tubular delivery stand apparatus comprising:

(a) a plurality of elevator columns;

(b) an elevator assembly mounted on each said elevator column, said elevator assembly having a wheeled skate with a removable pipe support, said removable pipe support positioned on said wheeled skate whereby a horizontally oriented length of pipe may be supported;

(c) a vertically extendable and retractable reciprocating actuator configured to move said wheeled skate and said pipe support and said length of pipe upward and downward along said elevator column, wherein said reciprocating actuator is a hydraulic cylinder and piston actuator;

(d) a cable attached to said wheeled lift skate and to said reciprocating actuator, wherein said cable is positioned on a sheave and pulley system;

(e) a removable pipe laydown cradle, said removable pipe laydown cradle positioned on said wheeled skate whereby a horizontally oriented length of pipe may be supported, said pipe laydown cradle selectively replaceable with said removable pipe support;

(f) a means for removing a length of pipe from said pipe laydown cradle;

(g) a support frame, said support frame comprising two sub-frames, each said sub-frame having a horizontally positioned base frame, a top frame, and vertically extending columns, each said sub-frame supporting an elevator column; and (h) a frame attachment and spacer bar pivotally attached to each said sub-frame frame whereby a longitudinally extending single support frame is formed by pinning together said frame attachment and spacer bars of each of said sub-frames.

2. The apparatus as recited in claim 1 further comprising a pipe pickup and laydown machine mounted on top of said support frame.

3. A tubular delivery stand apparatus comprising:

(a) first and second sub-frames, each said sub-frame having a horizontally positioned base frame, a top frame, and vertically extending columns, each said sub-frame frame having a frame attachment and spacer bar whereby a longitudinally extending single support frame is formed by joining said first sub-frame together with said second sub-frame by pinning together said frame attachment and spacer bars of each said sub-frame;

(b) a first vertically extending elevator column supported on said first sub-frame and a second vertically extending elevator column supported on said second sub-frame;

(c) a first elevator assembly mounted on said first elevator column and a second elevator assembly mounted on said second elevator column, each said elevator assembly comprising:

(i) a wheeled lift skate;

(ii) a pipe support mounted on said wheeled skate whereby a horizontally orientated length of pipe may span between and be supported by each said pipe support on each said elevator column;

(iii) a vertically extendable and retractable reciprocating actuator, (iv) a cable attached to said wheeled skate and to said reciprocating actuator, said cable positioned on a sheave and pulley system; and (d) a means for controlling each of said reciprocating actuator whereby said wheeled lift skates, and thereby said pipe supports, move vertically upward and downward in response to vertical extension and retraction of said reciprocating actuators.

4. The apparatus as recited in claim 3 wherein said reciprocating actuators are hydraulic cylinder and piston actuators.

5. The apparatus as recited in claim 3 wherein said reciprocating actuators are screw-type reciprocating actuators.

6. The apparatus as recited in claim 3 wherein each said elevator assembly has a removable pipe laydown cradle mounted on each of said wheeled lift skates.

7. The apparatus as recited in claim 6 further comprising:

(a) an elongated pipe roller guide bar, said pipe roller guide bar having a hole at one end for receiving a mounting pin;

(b) a roller guide post, said roller guide posting having a plurality of having adjustment holes; and (c) a roller guide pin whereby said pipe roller guide bar may be adjustably mounted on said roller guide post by means of said guide pin, said hole in said pipe roller guide bar, and a selected guide post adjustment hole from said plurality of roller guide post adjustment holes thereby providing adjustment of the angle and position of the roller guide bar with respect to each said sub-frame whereby engagement of a length of pipe that is supported on said pipe laydown cradles will be removed from said pipe laydown cradles by engagement of length of pipe with said pipe roller guide bar as said wheeled lift skates and said pipe laydown cradles are moved downward along said elevator columns.

8. The apparatus as recited in claim 7 further comprising a pipe pickup and laydown machine mounted on top of said single support frame.

9. The apparatus as recited in claim 8 further comprising a removable stabilizer bar mounted to each said base frame of each of said sub-frames.

10. The method of lifting pipe to an elevated pipe pickup and laydown machine comprising the steps of:

(a) providing a pipe pickup and laydown machine;

(b) providing a tubular delivery stand, said delivery stand comprising:

(i) first and second sub-frames, each said sub-frame having a horizontally positioned base frame, a top frame, and vertically extending columns, each said sub-frame frame having a frame attachment and spacer bar whereby a longitudinally extending single support frame is formed by pinning said first sub-frame together with said second sub-frame;

(ii) a first vertically extending elevator column supported on said first sub-frame and a second vertically extending elevator column supported on said second sub-frame;

(iii) a first elevator assembly mounted on said first elevator column and a second elevator assembly mounted on said second elevator column, each said elevator assembly comprising:

(iv) a wheeled lift skate;

(iv) a pipe support mounted on said wheeled skate whereby a horizontally orientated length of pipe may span between and be supported by each said pipe support on each said elevator column (v) a vertically extendable and retractable reciprocating actuator;

(vi) a cable attached to said wheeled skate and to said reciprocating actuator, said cable positioned on a sheave and pulley system;

(vii) a means for controlling each said reciprocating actuator whereby said wheeled lift skates, and thereby said pipe supports, move vertically upward and downward in response to vertical extension and retraction of said reciprocating actuators;

(c) forming a longitudinally extending single support frame by pinning said first sub-frame together with said second sub-frame;

(d) placing said pipe pickup and laydown apparatus atop said single support frame;

(e) rolling a length of pipe onto said pipe supports; and (f) actuating said actuators whereby said length of pipe is raised to the top of said single support frame and thereby placing it in position to be lifted by said pipe pickup and laydown machine.

11. The method as recited in claim 10 further comprising the step of lowering a length of pipe from said pipe pickup and laydown machine, said step of lowering a length of pipe from said pipe pickup and laydown machine comprising the steps of:

(a) providing a pipe removal assembly to said support frame, said pipe removal assembly comprised of:

(i) an elongated pipe roller guide bar, said pipe roller guide bar having a hole at one end for receiving a mounting pin;

(ii) a roller guide post, said roller guide post having a plurality of having adjustment holes; and (iii) a roller guide pin whereby said pipe roller guide may be adjustably mounted and angled on said roller guide post by means of said guide pin and said plurality of roller guide post adjustment holes;

(b) providing a pipe laydown cradle for attachment to each said skate and attaching one of said laydown cradles to each said skate of each said elevator assembly;

(c) moving said pipe laydown cradles to the top of the top of said single support frame by manipulation of said actuators;

(d) attaching said a pipe roller guide bar by means of said attachment hole on said elongated roller guide bar and said roller guide pin to a selected adjustment hole on said roller guide post whereby said pipe roller guide bar is selectively angled at a desired position;

(e) moving a length of pipe from said pipe pickup and laydown machine to said pipe laydown cradles whereby said length of pipe is supported on said pipe laydown cradles; and (f) moving said pipe laydown cradles toward said base of said single support frame by manipulation of said actuators whereby said length of pipe is brought into contact with said pipe roller guide bar whereby said length of pipe is lifted from said cradles and allowed to roll along said pipe roller guide bar onto the pipe rack.

12. The method as recited in claim 11 comprising the additional step of providing lateral stabilizer bars on said stand prior to said step of placing said pipe pickup and laydown apparatus atop said single support frame.

13. The combination of a tubular delivery apparatus and a pipe pick-up and laydown apparatus, said tubular delivery apparatus comprising:

(a) a frame comprised of first and second sub-frame, each of said sub-frames having a horizontally positioned base frame, a top frame, and at least one vertically extending column, said top frame of each said sub-frame;

(b) an elevator column mounted to each of said sub-frames;

(c) an elevator assembly mounted on each of said elevator columns, each of said elevator assemblies having an elevator pipe support;

(d) a horizontally oriented length of pipe spanning between each said pipe support;

(d) a hoist network configured with each said elevator assembly, said hoist network having a vertically extendable and retractable reciprocating actuator, a wheeled skate, and a cable attached to said wheeled skate and to said extendable and retractable reciprocating actuator, whereby vertical extension and retraction of said actuators will move said wheeled skates with elevator pipe supports by means of said cables, and thereby said length of pipe, upward and downward along said elevator columns;

(e) a pipe pick-up and laydown apparatus supported upon said top frames of said first and second sub-frames, said pipe pick-up and laydown apparatus; and (f) a means for transferring said length of pipe from said pipe supports to said pipe pick-up and laydown apparatus.

14. The tubular delivery stand apparatus recited in claim 13 further comprising an elongated pipe roller guide bar adjustably mounted to said frame, said elongated pipe roller guide bar configured to intersect with said horizontally oriented length of pipe as said first and second wheeled skates move downward on said first and second elevator columns thereby rollably removing said horizontally oriented length of pipe from said first and second elevator assemblies.

15. The tubular delivery stand apparatus recited in claim 14 wherein said pipe roller guide bar has a mounting pin hole provided at one end, said tubular delivery stand apparatus further comprising:

(a) a roller guide post on said frame, said roller guide post having a plurality of having adjustment holes; and (b) a roller guide pin whereby said pipe roller guide bar may be adjustably mounted and angularly positioned on said roller guide post by means of said guide pin, said plurality of roller guide post adjustment holes, and said mounting pin hole of said adjustable guide bar.

* * * * *